US006942761B1

(12) United States Patent
Prinzing et al.

(10) Patent No.: US 6,942,761 B1
(45) Date of Patent: Sep. 13, 2005

(54) PRESS DEVICE AND METHOD OF USING THE SAME

(75) Inventors: Hans Prinzing, Heidenheim (DE); Rainer Bentele, Friedrichshafen (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/228,658

(22) Filed: Jan. 12, 1999

(30) Foreign Application Priority Data

Jan. 12, 1998 (DE) ..... 198 00 807

(51) Int. Cl.[7] ..... D21F 3/00
(52) U.S. Cl. ..... 162/360.3; 162/358.3; 162/358.5; 100/153
(58) Field of Search ..... 162/358.3, 358.5, 162/360.3; 100/153, 155 R, 176, 154

(56) References Cited

U.S. PATENT DOCUMENTS

| | | | |
|---|---|---|---|
| 5,753,083 | A | 5/1998 | Schiel et al. |
| 5,788,817 | A | 8/1998 | Bentele et al. |
| 5,908,537 | A | 6/1999 | Bentele et al. |

FOREIGN PATENT DOCUMENTS

| | | | |
|---|---|---|---|
| DE | 19520443 | | 12/1996 |
| DE | 29706432 | | 7/1997 |
| EP | 0745725 | | 12/1996 |
| EP | 752495 | * | 1/1997 |

OTHER PUBLICATIONS

Gary A. Smook, "Handbook for Pulp & Paper Technologists, 2nd. Ed", Angus Wilde Publications, p. 253, 1992.*

* cited by examiner

*Primary Examiner*—Dionne A. Walls
(74) *Attorney, Agent, or Firm*—Greenblum & Bernstein, P.L.C.

(57) ABSTRACT

Press device and method of using the same for treating a fibrous material web that includes a shoe press unit that includes a flexible press belt that revolves around a non-rotating carrier, a counter roll that includes a deflection compensation roll with a roll jacket revolving around a second non-rotating carrier, a third roll, a roll nip formed between the counter roll and the third roll, a press nip elongated in a web travel direction and formed between the shoe press unit and the counter roll, at least one first support element where the flexible press belt is supported on the non-rotating carrier by the at least one first support element in the region of the elongated press nip, at least one second support element where the roll jacket is supported on the second non-rotating carrier by the at least one second support element in the region of the elongated press nip. A changeable pressure differential occurs between internal pressures generated by the at least one first support element acting on the flexible press belt of the shoe press unit, and the at least one second support element acting on the roll jacket of the counter roll.

29 Claims, 2 Drawing Sheets

PRESS DEVICE AND METHOD OF USING THE SAME

CROSS-REFERENCE TO RELATED APPLICATIONS

The present application claims priority under 35 U.S.C. § 119 of German Patent Application No. 198 00 807.4, filed Jan. 12, 1998, the disclosure of which is expressly incorporated by reference herein in its entirety.

BACKGROUND OF THE INVENTION

1. Field of the Invention

The present invention relates to a press device and method of using the same for treating a fibrous material web, and more specifically to a press device with variably adjustable pressure and line force.

2. Discussion of Background Information

The present invention relates to press device and method of using the same for treating a fibrous material web, in particular a paper and/or cardboard web. A press device has a press nip that is elongated in the web travel direction, and is formed between a shoe press unit and a counter roll. The press device also has a roll nip that is formed between the counter roll and another roll. The shoe press unit includes a flexible press belt, which revolves around a non-rotating carrier and, in the region of the elongated press nip, is supported on the carrier by at least one support element. The counter roll is embodied as a deflection compensation roll with a roll jacket, which revolves around a non-rotating carrier and; in the region of the elongated press nip, is in turn supported on the relevant carrier by at least one support element. Preferably the pressure fluid-actuated support elements are designed, and can be actuated, in such a way that a pressure differential is produced with regard to the internal pressures, which are generated by means of the support elements, and act on the flexible press belt of the shoe press unit or act on the roll jacket of the counter roll.

With a press device of this kind in which the shoe press is usually disposed on top, a line force that is as even as possible should be generated even in the roll nip that is not deflection-controlled, which is achieved by means of a corresponding pressure differential or a corresponding line force differential between the shoe press unit and the counter roll. The pressure differential brings about the fact that the line force acting in the elongated press nip formed between the shoe press unit and the counter roll is not compensated for to the full extent by means of the internal support elements of the counter roll. The remaining force causes a deformation of the counter roll both in the elongated press nip formed by the shoe press unit, which can be easily compensated for by the flexible support element of the shoe press unit, and in the roll nip formed between the counter roll and the other roll. If the pressure differential is selected, for example, so that a greater pressure occurs in the shoe press unit than in the counter roll, then a deflection of the counter roll occurs in form of a bulging towards the other roll in the roll nip formed between the counter roll and the other roll. Due to this bulging, the counter roll and the other roll can, for example, be embodied with a reduced cambering for the deflection compensation. With a slighter cambering of this kind, the speed differentials between the roll center and the roll ends can be kept small. In particular, such a line force differential can consequently be produced between the shoe press unit and the counter roll, which produces a deflection of the counter roll in the roll nip and as a result, permits a reduction of the required cambering in this roll nip.

DE-A-195 20 443.3 discloses a press device where the pressure differential or the line force differential is fixed at a constant value. However, a fixed pressure differential, just as the lack of a pressure differential, brings with it the disadvantage that the line force can only be adjusted, at most, in a very limited range. This can in particular be traced to the fact that the deformations, that are a function of the line force, can no longer be correctly compensated for by means of the fixed camberings provided and this consequently leads to deviations of the pressure profile occurring over the web width.

It is also known to have a central roll that has an additional series of support elements which are provided in the direction of the roll nip toward the preceding roll, and regulates the deflection compensation in this roll nip. However, this presents a problem in that such an additional series of support elements is connected with considerable additional expenditures, and is correspondingly costly.

SUMMARY OF THE INVENTION

Accordingly, the present invention is directed to a method and apparatus for a press device that substantially obviates one or more of the problems arising from the limitations and disadvantages of the related art.

It is an object of the present invention to provide a press device that is reasonably priced and simple in design, in which the line force in the roll nip is adjustable in a relatively wide range.

It is another object of the present invention to provide a press device where the pressure profile that is produced in the roll nip lateral to the web travel direction can be varied without requiring an additional series of support elements of the counter roll for this purpose.

Accordingly, one aspect of the present invention is directed to a press device for treating a fibrous material web that includes: a shoe press unit, the shoe press unit includes a flexible press belt that revolves around a non-rotating carrier; a counter roll including a deflection compensation roll with a roll jacket revolving around a second non-rotating carrier; a third roll; a roll nip formed between the counter roll and the third roll; a press nip elongated in a web travel direction, and formed between the shoe press unit and the counter roll; at least one first support element, the flexible press belt supported on the non-rotating carrier by the at least one first support element in the region of the elongated press nip; and at least one second support element, the roll jacket supported on the second non-rotating carrier by the at least one second support element in the region of the elongated press nip, wherein a changeable pressure differential occurs between internal pressures generated by the at least one first support element acting on the flexible press belt of the shoe press unit, and the at least one second support element acting on the roll jacket of the counter roll.

According to another aspect of the present invention, the at least one first support element is pressure fluid-actuated.

According to yet another aspect of the present invention, the at least one second support element is pressure fluid-actuated.

According to a further aspect of the present invention, the fibrous material web comprises at least one of a paper web or a cardboard web.

According to another aspect of the present invention, a line force differential between the shoe press unit and the counter roll is changeable with the pressure differential.

According to yet another aspect of the present invention, a cross-section of the pressure differential is produced lateral to the web travel direction, the cross-section of the pressure differential is changeable so different pressure differentials are adjustable over the width.

According to a further aspect of the present invention, the line force in the roll nip is changeable by way of the pressure differential.

According to another aspect of the present invention, line forces that are at least essentially even are adjusted in the roll nip by way of the variable pressure differential.

According to yet another aspect of the present invention, the pressure differential or the line force differential is continuously changeable in areas.

According to a further aspect of the present invention, the internal pressure produced by the at least one first support element is changeable to change the pressure differential.

According to another aspect of the present invention, the internal pressure produced by the at least one second support element is changeable to change the pressure differential.

According to yet another aspect of the present invention, both the internal pressure produced by the at least one first support element and the internal pressure produced by the at least one second support element is changeable to change the pressure differential.

According to a further aspect of the present invention, the at least one first support element and the at least one second support element are connected to a common pressure fluid line, an adjustable pressure reduction device is provided in the pressure fluid connection between the common pressure fluid line and the at least one first support element or the pressure fluid connection between the common pressure fluid line and the at least one second support element, the pressure differential is changeable by the adjustable pressure reduction device.

According to another aspect of the present invention, at least one of the at least one first support element and the at least one second support element is connected to the common pressure fluid line individually, in groups, or all together.

According to yet another aspect of the present invention, the adjustable pressure reduction device is provided between at least one of the groups of the at least one second support element and the common pressure fluid line, thereby reducing the pressure of the at least one second support element connected to the common pressure fluid line in groups.

According to a further aspect of the present invention, the adjustable pressure reduction device is provided between at least one individual at least one second support element and the common pressure fluid line, thereby reducing the pressure of the at least one second support element individually connected to the common pressure fluid line.

According to another aspect of the present invention, the adjustable pressure reduction device includes at least one variably adjustable valve.

According to yet another aspect of the present invention, the pressure differential and/or the line force differential are externally adjustable.

According to a further aspect of the present invention, the pressure differential and/or the line force differential are adjustable mechanically, hydraulically, pneumatically, manually, by remote control, at the size, from a control position, or in a process-guided manner.

According to another aspect of the present invention, the pressure differential is adjustable as a function of a line force in the roll nip by predeterminable characteristic curves.

According to yet another aspect of the present invention, the pressure differential is adjustable as a function of line force correction procedures for the roll nip, wherein the line force correction procedures may be at least one of input by way of an electronic control and produced by way of corresponding signals of a process guidance system.

According to a further aspect of the present invention, the pressure differential is adjustable by way of a regulating system that includes at least one closed regulation loop.

According to another aspect of the present invention, a line force in a second roll nip formed between the third roll and a fourth roll, is changeable by way of the pressure differential.

According to yet another aspect of the present invention, the counter roll and/or the third roll are cambered.

According to a further aspect of the present invention, the third roll, the fourth roll, and the counter roll are cambered.

According to another aspect of the present invention, the shoe press unit includes a shoe press roll and the flexible press belt, the flexible press belt being a flexible press jacket.

According to another aspect of the present invention, the shoe press unit is disposed above the counter roll.

According to yet another aspect of the present invention, the ends of the roll jacket of the counter roll are supported on the relevant carrier so that the roll jacket cannot move radially.

According to a further aspect of the present invention, an action plane of the at least one second support element of the counter roll inclined slightly in relation to a second action plane of the at least one first support element of the shoe press unit, wherein an inclination angle preferably lies in a range from about 2° to 15°.

According to another aspect of the present invention, an inclination angle in particular lies in a range from about 4° to 8°.

According to another aspect of the present invention, an action plane of the at least one second support element of the counter roll coincides, at least essentially, with a second action plane of the at least one first support element of the shoe press unit.

According to yet another aspect of the present invention, pressure-active surfaces of the at least one second support element are not equal to second pressure-active surfaces of the at least one first support element of the shoe press unit.

According to a further aspect of the present invention, the invention includes a method of treating a fibrous material with a press device capable of variably adjustable pressure and variably adjustable line force that includes: forming a press nip between a shoe press unit and a counter roll, the press nip elongated in a web travel direction; supporting a flexible press belt, that revolves around a non-rotating carrier, on at least one first support unit, the flexible press belt supported in the region of the elongated press nip; forming a roll nip between the counter roll and a third roll; supporting a roll jacket, that revolves around a second non-rotating carrier, on at least one second support unit, the roll jacket supported in the region of the elongated press nip; supplying a fluid to the at least one first support unit and the at least one second support unit; adjusting a pressure differential between internal pressures generated by the at least one first support element acting on the flexible press belt, and the at least one second support element acting on the roll jacket; the pressure differential adjusted by adjusting of the pressure of the fluid supplied to the at least one first support unit and the at least one second support unit Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

Figure 1:
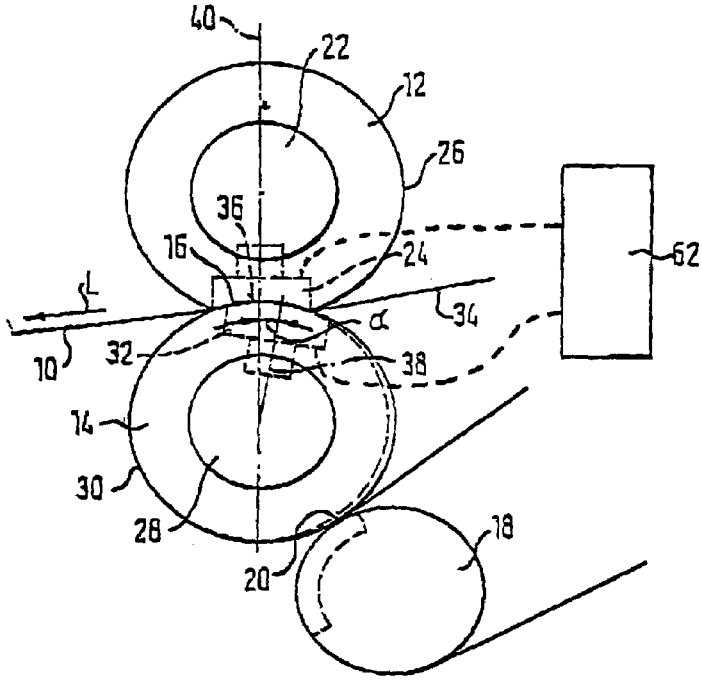
FIG. 1 is a schematic cross-sectional representation of an exemplary embodiment of a press device with three press rolls according to the present invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

In the press device according to the present invention, the pressure differential may be changed. As a result, preferably the line force differential between the shoe press unit and the counter roll may also be changed with the pressure differential.

A variably adjustable pressure differential between the shoe press unit and the counter roll, in particular, allows a deformation in the roll nip formed between the counter roll and the other roll to be variable. As a result, in this otherwise not deflection-controlled roll nip, line forces can be adjusted over a wide range, wherein an optimal pressure cross-section is also always assured.

Another advantage of the variably changeable pressure differential between the shoe press unit and the counter roll is that with an intentional adjustment of the pressure differential, cross-section corrections can be carried out in the roll nip formed between the counter roll and another roll. As a result, the moisture cross-section may consequently also be adjusted in the desired manner after the press. With a change of the pressure differential or the line force differential between the shoe press unit and the counter roll, the deflection of the counter roll in the roll nip also changes and, as a result, so does the pressure distribution being produced in the roll nip. In this connection, the press distribution changes only in the roll nip. A deflection change of the counter roll in the elongated press nip is compensated for by the flexible press shoe. As a result, it is possible to keep the line forces that act on the fibrous material web in at least one roll nip unchanged at the respectively adjusted desired value. Even with a change of the line forces in the neighboring press nips, an optimal, even line force can always be achieved in the roll nip formed between the counter roll and the other roll.

In order to improve the moisture cross-section in the roll nip formed between the counter roll and the other roll, corrections of the line force are possible in the form of edge reliefs or edge loadings. In addition, the replacement of the other roll, that forms the roll nip with the counter roll, by a different roll with a different rigidity is simplified wherein the different rigidity can, for example, be sue to the material, the wall thickness, or in the case of a suction roll, the bore pattern. Furthermore, a simpler adaptation to another magnitude of deformation in the roll nip is produced, which can be caused, for example, by a changed vacuum in the other roll. As a result, the previously possible cambering change of the counter roll and the other roll by a corresponding change of the pressure differential between the shoe press unit and the counter roll can be avoided.

In a press device according to the present invention, it is particularly advantageous if the pressure differential, or the line force differential, can be changed continuously, at least in areas. In order to change the pressure differential, for example, the internal pressure, that is produced by the support elements of the shoe press unit and acts on its flexible press belt, may be changed. The pressure differential may be changed also, for example, if the internal pressure, that is produced by the support elements of the counter roll and acts on its roll jacket, can also be changed. It is also possible that to change the pressure differential, both the internal pressure, that is produced by the support elements of the shoe press unit and acts on its flexible press belt, and the internal pressure, that is produced by the support elements of the counter roll and acts on its roll jacket, may be changed.

In an aspect of the press device according to the present invention, the support elements of the shoe press unit and the support elements of the counter roll are connected to a common pressure fluid line. Adjustable pressure reduction devices are provided in the pressure fluid connection between the common pressure fluid line and the support element(s) of the shoe press unit, and/or in the pressure fluid connection between the common pressure fluid line and the support element(s) of the counter roll. The pressure differential can be changed by way of these variable pressure reduction devices.

The support elements of the shoe press unit and/or the support elements of the counter roll can be connected to the common pressure fluid line individually, in groups, or all together. In order to reduce the pressure of support elements connected to the common pressure fluid line in groups, an adjustable pressure reduction device may be provided between at least one, preferably each, of these groups of support elements and the common pressure fluid line. In order to reduce the pressure of support elements individually connected to the common pressure fluid line, an adjustable pressure reduction device may be provided between at least one, preferably each, of these individual support elements and the common pressure fluid line.

In another aspect of a press device according to the present invention, the pressure reduction device includes at least one variably adjustable valve.

In most instances, it is suitable if the pressure differential or the line force differential may be adjusted from the outside. The pressure differential or the line force differential may be adjusted, for example, mechanically, hydraulically, pneumatically, manually, by remote control, at the site, from a control position, and/or in a process-guided manner, as in conventional.

In another aspect of a press device according to the present invention, the pressure differential may be adjusted as a function of the line force in the roll nip by using characteristic curves that may be predetermined, as is conventional. The pressure differential may also be adjusted as a function of line force correction procedures for the roll nip. The line force correction procedures may preferably be input by way of an electronic control and/or may be produced by way of corresponding signals of a process guidance system. The pressure differential may in particular also be adjusted by way of a regulating system that includes at least one closed regulation loop.

In another aspect of a press device according to the present invention, the line force in another roll nip, which is formed between the other roll and an additional roll, may be changed by way of the pressure differential. The additional roll may for example be a suction roll.

At least the counter roll and/or the other roll that forms the roll nip together with the counter roll may be suitably cambered. Due to the changeable pressure differential, or the changeable line force differential, a cambering of this kind may be more slight than normal. In some cases, a cambering of this kind may also be completely eliminated.

In another aspect of a press device according to the present invention, the shoe press unit is formed by a shoe press roll with a flexible press jacket as a press belt. The shoe press unit is suitably disposed above the counter roll.

In another aspect of a press device according to the present invention, the roll jacket of the counter roll is supported on its ends so that it cannot move radially on the relevant carrier.

In certain instances, it may be useful if the action plane of the at least one support element of the counter roll is inclined slightly in relation to the action plane of the at least one support element of the shoe press unit. It may also be possible that the action plane of the at least one support element of the counter roll coincides, at least essentially, with the action plane of the at least one support element of the shoe press unit.

In another aspect of a press device according to the present invention, the pressure-active surfaces of the support elements of the counter roll are not equal to the pressure-active surfaces of the at least one support element of the shoe press unit. An action that is similar to that of the support elements of the counter roll which are inclined out of the action plane of the elongated press nip may also be correspondingly produced by virtue of the fact that the pressure-active surfaces of these support elements may not be equal to the surfaces of the support elements of the shoe press unit. A line force differential between the two rolls is already achieved upon connection to a common pressure line, by the different internal pressure surfaces. In addition, variable pressure reduction devices may now be inserted into one or both supply lines in order to achieve the advantages mentioned above.

Figure 2:
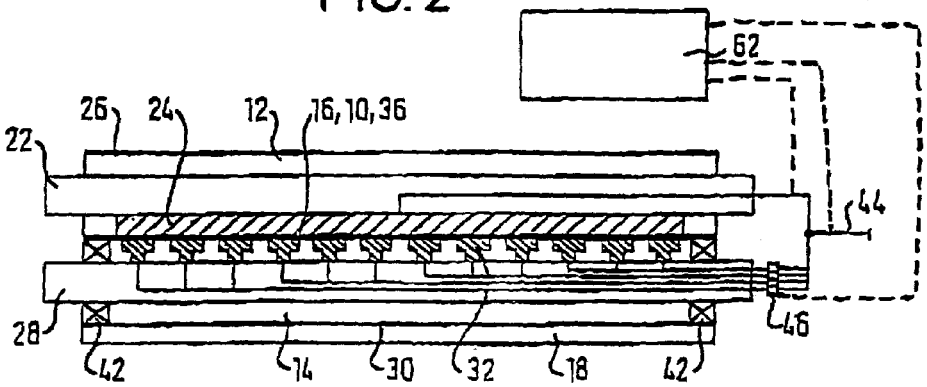
FIG. 2 is a schematic longitudinal representation of the exemplary embodiment shown in FIG. 1 in which the pressure fluid connections that are routed to the support elements are also shown.

FIGS. 1 and 2 show a schematic representation of a first exemplary embodiment of a press device according to the present invention which may be used for treating a fibrous material web 10, in particular a paper and/or cardboard web. This press device has a press nip 16 that is elongated in the web travel direction L and is formed between a shoe press unit—a shoe press roll 12 in this instance—and a counter roll 14, and has a roll nip 20 that is formed between the counter roll 14 and another roll—a suction roll 18 in this instance.

The shoe press roll 12, disposed directly above the counter roll 14, has a flexible press jacket 26, which is used as a press belt. Shoe press roll 12 revolves around a non-rotating carrier 22, and is supported against carrier 22 in the region of the elongated press nip 16 by a support element 24.

Counter roll 14, in this instance, may be embodied as a deflection compensation roll. Counter roll 14 has a roll jacket 30, which revolves around a non-rotating carrier 28 and is supported on carrier 28 in the region of the elongated press nip 16 by a series of support elements 32 that extend lateral to the web travel direction L. As shown in FIG. 1, suction roll 18 may be disposed obliquely beneath counter roll 14. The rolls 12, 14, and 18 are supported in a seating that is not shown. In addition to the fibrous material web 10, drainage felts 34 travel through the press nips 16 and 20 in order to absorb water expressed from the fibrous material web 10.

The hydraulic support element 24 of the shoe press roll 12, which is in the form of an axially extending strip supported on the carrier 22, may be provided with a concave support surface 36 in the current instance. Instead of a strip supported on a hydraulic pressure cushion, a number of support elements 24 may also be used. The lubrication of the gap between the support face 36 and the inner surface of the flexible press jacket 26 may take place in a hydrostatic and/or hydrodynamic manner.

The press nip 16 that is elongated in the web travel direction L may be formed by the concave support surface 36 and the approximately cylindrical counter roll 14.

On its ends, roll jacket 30 of counter roll 14 may be supported on carrier 28 so that it cannot be moved radially.

In this exemplary embodiment of a press device according to the present invention, the action plane 38 of support elements 32 of counter roll 14 may be inclined slightly in relation to the plane 40 of support element 24 of shoe press roll 12. The inclination angle $\alpha$ preferably lies in a range from about 2° to 15°, and in particular, in a range from about 4° to 8°. It may also be possible that action plane 38 of support elements 32 of counter roll 14 coincides, at least essentially, with action plane 40 of support element 24 of shoe press roll 12.

Since roll jacket 30 of counter roll 14 is fixed at the ends by way of bearings 42 on carrier 28, the deformation of roll jacket 30 of counter roll 14 that results from the inclination of support elements 32 (shown in FIG. 1) has a particularly strong effect in the central region so that roll jacket 30 there deforms more intensely toward suction roll 18.

In the present exemplary embodiment, support element 24 of shoe press roll 12 and support elements 32 of counter roll 14 are connected to a common pressure fluid line 44. The support elements 32, in FIG. 2, of counter roll 14 may be connected in groups to common pressure fluid line 44.

The pressure fluid-actuated support elements 24 and 32 may be acted on so that with regard to the internal pressures, (which are produced by these support elements 24, 32 and act on the flexible press jacket 26 of shoe press roll 12 or roll jacket 30 of counter roll 14), a pressure differential occurs that may also be determined in part by a different size of the pressing surfaces of the support elements 24, 32. According to the present invention, this pressure differential may be changed. In particular, the line force differential between shoe press roll 12 and counter roll 14 may also be changed with this pressure differential. Preferably, the cross-section of the pressure differential between shoe press roll 12 and counter roll 14, which cross-section is produced lateral to the web travel direction L, may be changed so that, in particular, different pressure differentials may be adjusted over the width. By way of the variable pressure differential between shoe press unit 12 and counter roll 14, the line force in roll nip 20 may consequently also be changed, wherein line forces may be adjusted in roll nip 20 that may be at least substantially even. The pressure differential or the line force differential may be changed continuously, at least in areas. The pressure differential or the line force differential may be adjusted externally in the current instance. The adjustment may be carried out, for example, mechanically, hydraulically, pneumatically, manually, by remote control, at the site, from a control position, and/or in a process-guided manner, as is conventional. The pressure differential may, for example, be adjusted as a function of the line force in roll nip 20 by characteristic curves that may be predetermined, as is conventional. It may in particular also be adjusted as a function of line force correction procedures for roll nip 20. In this embodiment of a press device according to the present invention, the adjustment takes place by way of an electronic control 62. It is in particular also possible that, for example, the respective line force correction procedures and/or the like may be produced by way of corresponding signals of a process guidance system. In addition, the pressure differential may be adjusted by way of a regulating system that include at least one closed regulation loop.

In the present exemplary embodiment of a press device according to the present invention, the internal pressure, which is produced by support elements 32 of the counter roll 14 and acts on its roll jacket 30, may be changed in order to change the pressure differential (see FIG. 2). In this embodiment, adjustable or variably adjustable pressure reduction devices 46 are provided in the pressure fluid connection between the common pressure fluid line 44 and support elements 32 of counter roll 14, wherein the pressure differential may be changed by way of these variable pressure reduction devices 46. In order to reduce the pressure of support elements 32 that are connected in groups to the common pressure fluid line 44, an adjustable or variably adjustable pressure reduction device 46 may be respectively provided between each group of support elements 32 and the common pressure fluid line 44. In contrast to this, support element 24 of shoe press roll 12 may be directly connected to the common pressure fluid line 44. The pressure reduction device 46 may, for example, respectively include a variably adjustable valve.

The deformation in roll nip 20 formed between counter roll 14 and suction roll 18 may also be variably influenced by the variably adjustable pressure differential between shoe press roll 12 and counter roll 14. As a result, in this otherwise not deflection-controlled roll nip 20, line forces may be adjusted over a wide range, wherein an optimal pressure cross-section is also always assured. With an intentional adjustment of the variable pressure differential between shoe press roll 12 and counter roll 14, cross-section corrections may be carried out in roll nip 20 formed between counter roll 14 and suction roll 18.

Due to the pressure differential that may be changed according to the present invention, though, this cambering of the rolls can be kept relatively slight. In certain instances, such a cambering may even be entirely eliminated.

In the exemplary press device according to the present invention shown in FIG. 2, a higher pressure may be produced in shoe press roll 12 than in counter roll 8. In order to influence the cross-section in the preceding roll nip 20, however, the reverse instance may also be suitable, in which a higher pressure is exerted on roll jacket 30 of counter roll 14 than on press jacket 26 of shoe press roll 12. In this embodiment, the pressure reduction devices 46 may be inserted between the common pressure fluid line 44 and a desired number of support elements or support element groups of shoe press roll 12. The reduced pressure, however, may always continue to have such a value that the desired line force is produced in the elongated press nip 16 formed between shoe press roll 12 and counter roll 14. The roll nip 20 is now influenced in the opposite fashion. In this instance, namely, an increase in the overall deformation occurs. This may be of use, particularly in relatively narrow paper making machines, where the purpose of the cambering reduction plays a subordinate role in roll nip 20 formed between counter roll 14 and the other roll 18.

An even higher measure of variability may be achieved if variably adjustable pressure reduction devices 46 are inserted both in the pressure fluid connections to shoe press roll 12 and in the pressure fluid connections to counter roll 14. The line forces in roll nip 20 may then be adjusted in an even wider line force range, wherein an even pressure cross-section in roll nip 20 may always be produced. Then edge corrections of the line force in roll nip 20 may be carried out in the positive direction (edge over-pressing) and in the negative direction (edge relief), for example, by way of correction procedures.

Figure 3:
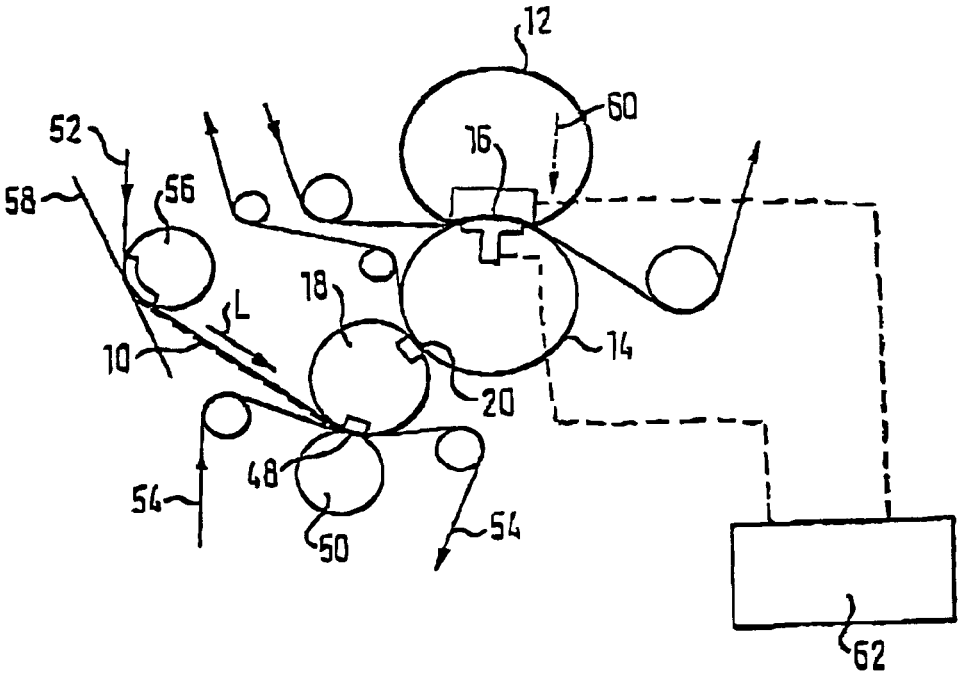
FIG. 3 is a schematic cross-sectional representation of another exemplary embodiment of a press device with four press rolls according to the present invention.

FIG. 3 shows a schematic cross-sectional representation of an exemplary embodiment of a press device with four press rolls. This embodiment differs from the one shown in FIGS. 1 and 2 essentially by the fact that before roll nip 20 in terms of the web travel direction L, a further roll nip 48 may be provided, which is formed between further suction roll 18 and an additional roll 50 disposed underneath it. This additional roll nip 48 may be double-felted, while the two press nips 20 and 16 following it in the web travel direction L respectively may have single felts. The upper felt 52, which is guided through the additional roll nip 48 also travels through roll nip 20. The additional roll 50 may be disposed inside the loop of the lower felt 54 guided through roll nip 48. The fibrous material web 10 may be taken over from the upper felt 52 by a wire belt 58 in the region of a suction roll 56 before being guided through roll nip 48. Otherwise, this exemplary embodiment essentially has the same design as that according to FIGS. 1 and 2, wherein parts that correspond to one another are provided with the same reference numerals.

Consequently, a pressure differential or a line pressure differential 60 may again be generated between shoe press roll 12 and counter roll 14, wherein the pressure differential or the line pressure differential 60 may again be changed and preferably may be adjusted in a variable and smooth manner. In the current embodiment, the line force in the other roll nip 48 may in particular also be changed by way of the variable pressure differential or the variable line pressure differential 60 between shoe press roll 12 and counter roll 14. As a result, this pressure differential or this line pressure differential 60 between shoe press roll 12 and counter roll 14 may in particular be adjusted in a variable and smooth manner. As a result, the deflection of the central or counter roll 14 also changes again in roll nip 20 and consequently the press distribution in this roll nip 20 can also change. It is therefore possible to keep the line forces acting on the fibrous material web 10 in the roll nip 20 and the elongated press nip 16 at the respectively desired value. The adjustment of the line pressure differential 60 or the pressure differential also may occur in the current exemplary embodiment, again by way of an electronic control 62. The adjustment may be carried out, for example, mechanically, hydraulically, pneumatically, manually, by remote control, at the site, from a control position, and/or in a process-guided manner, as is conventional. Here, too, a second series of support elements in the direction of roll nip 20 may be eliminated. The variable line force differential may in particular be used for influencing the press distribution in roll nip 20, without the respectively desired line forces in press nips 20, 16, and 48 from being changed in the process. In particular, the line force in roll nip 20 may be adjusted in a relatively wide range in the desired manner by way of the variable pressure differential or the variable line pressure differential. An intentional influence of the conditions in the other roll nip 48 may also be possible.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made within the purview of the appended claims, as presently stated and as amended, without departing from the scope and spirit of the present invention in its aspects. Although the present invention has been described herein with reference to particular means, materials, and embodiments, the present invention is not intended to be limited to the particulars disclosed herein; rather, the present invention extends to all functionally equivalent structures, methods and uses, such as are within the scope of the appended claims.

What is claimed is:

1. A press device for treating a fibrous material web comprising:

a shoe press unit, said shoe press unit comprising a flexible press belt that revolves around a non-rotating carrier;

a counter roll, said counter roll comprising a deflection compensation roll with a roll jacket revolving around a second non-rotating carrier;

a third roll;

a roll nip, said roll nip formed between said counter roll and said third roll;

a press nip, said press nip elongated in a web travel direction, and formed between said shoe press unit and said counter roll;

at least one first support element being pressure fluid-actuated, the flexible press belt supported on the non-rotating carrier by said at least one first support element in the region of the elongated press nip;

at least one second support element being pressure fluid-actuated, the roll jacket supported on the second non-rotating carrier by said at least one second support element in the region of the elongated press nip, a pressure fluid line arranged to generate internal pressures by the at least one first support element on the flexible press belt of the shoe press unit and by the at least one second support element on the roll jacket of the counter roll;

an adjustment device arranged to change a pressure differential between the internal pressures generated by the at least one first support element acting on the flexible press belt of the shoe press unit, and the at least one second support element acting on the roll jacket of the counter roll, said adjustment device being structured and arranged to adjust the pressure differential as at least one of a function of a line force in the roll nip by predeterminable characteristic curves, and a function of line force correction procedures for the roll nip; and an electronic control coupled to the adjustment device, whereby the electronic control and the adjustment device adjust the pressure differential, wherein the line force correction procedures are at least one of input by way of the electronic control and produced by way of corresponding signals of a process guidance system, and wherein adjustment of the pressure differential provides cross-section corrections in the roll nip.

2. The press device according to claim 1, the fibrous material web comprising at least one of a paper web and a cardboard web.

3. The press device according to claim 1, a line force differential between the shoe press unit and the counter roll being changeable with the pressure differential.

4. The press device according to claim 3, the line force in the roll nip changeable by way of the pressure differential.

5. The press device according to claim 1, a line force differential between the shoe press unit and the counter roll being changeable with the pressure differential.

6. The press device according to claim 4, line forces that are at least essentially even being adjusted in the roll nip by way of the variable pressure differential.

7. The press device according to claim 3, at least one of the pressure differential and the line force differential being externally adjustable.

8. The press device according to claim 3, at least one of the pressure differential and the line force differential being adjustable by one of mechanically, hydraulically, pneumatically, manually, by remote control, at the site, from a control position, and in a process-guided manner.

9. The press device according to claim 1, a cross-section of the pressure differential being produced lateral to the web travel direction, the cross-section of the pressure differential being changeable so different pressure differentials are adjustable over the width.

10. The press device according to claim 1, the internal pressure produced by the at least one first support element being changeable to change the pressure differential.

11. The press device according to claim 1, the internal pressure produced by the at least one second support element being changeable to change the pressure differential.

12. The press device according to claim 1, both the internal pressure produced by the at least one first support element and the internal pressure produced by the at least one second support element being changeable to change the pressure differential.

13. The press device according to claim 1, wherein the pressure fluid line is a common pressure fluid line, and the at least one first support element and the at least one second support element being connected to the common pressure fluid line, the adjustment device comprising an adjustable pressure reduction device provided in at least one of the pressure fluid connection between the common pressure fluid line and the at least one first support element, and the pressure fluid connection between the common pressure fluid line and the at least one second support element, the pressure differential being changeable by the adjustable pressure reduction device.

14. The press device according to claim 13, at least one of the at least one first support element and the at least one second support element being connected to the common pressure fluid line one of individually, in groups, and all together.

15. The press device according to claim 14, the adjustable pressure reduction device being provided between at least one of the groups of the at least one second support element and the common pressure fluid line, thereby reducing the pressure of the at least one second support element connected to the common pressure fluid line in groups.

16. The press device according to claim 14, the adjustable pressure reduction device being provided between at least one individual at least one second support element and the common pressure fluid line, thereby reducing the pressure of the at least one second support element individually connected to the common pressure fluid line.

17. The press device according to claim 13, the adjustable pressure reduction device including at least one variably adjustable valve.

18. The press device according to claim 1, the pressure differential being adjustable by way of a regulating system that includes at least one closed regulation loop.

19. The press device according to claim 1, a line force in a second roll nip formed between the third roll and a fourth roll being changeable by way of the pressure differential.

20. The press device according to claim 19, the third roll, the fourth roll, and the counter roll being cambered.

21. The press device according to claim 1, at least one of the counter roll and the third roll being cambered.

22. The press device according to claim 1, the shoe press unit comprising a shoe press roll and the flexible press belt, the flexible press belt comprising a flexible press jacket.

23. The press device according to claim 1, the shoe press unit disposed above the counter roll.

24. The press device according to claim 1, the ends of the roll jacket of the counter roll being supported on the relevant carrier so that the roll jacket cannot move radially.

25. The press device according to claim 1, an action plane of the at least one second support element of the counter roll inclined slightly in relation to a second action plane of the at least one first support element of the shoe press unit, wherein an inclination angle lies in a range from about 2° to 15°.

26. The press device according to claim 25, the inclination angle lies in a range from about 4° to 8°.

27. The press device according to claim 1, an action plane of the at least one second support element of the counter roll coinciding, at least essentially, with a second action plane of the at least one first support element of the shoe press unit.

28. The press device according to claim 1, comprising pressure-active surfaces of the at least one second support element being not equal to second pressure-active surfaces of the at least one first support element of the shoe press unit.

29. A method of treating a fibrous material with a press device capable of variably adjustable pressure and variably adjustable line force, said method comprising:

forming a press nip between a shoe press unit and a counter roll, the press nip elongated in a web travel direction;

supporting a flexible press belt, that revolves around a non-rotating carrier, on at least one first support element, the flexible press belt supported in the region of the elongated press nip;

forming a roll nip between the counter roll and a third roll;

supporting a roll jacket, that revolves around a second non-rotating carrier, on at least one second support element, the roll jacket supported in the region of the elongated press nip;

supplying a fluid to the at least one first support element and the at least one second support element; and adjusting with an electronic control and an adjustment device a pressure differential between internal pressures generated by the at least one first support element acting on the flexible press belt, and the at least one second support element acting on the roll jacket, the pressure differential adjusted by adjusting of the pressure of the fluid supplied to the at least one first support element and the at least one second support element, wherein the pressure differential is adjusted as at least one of a function of a line force in the roll nip by predeterminable characteristic curves and a function of line force correction procedures for the roll nip, wherein the electronic control is coupled to the adjustment device, wherein the line force correction procedures are at least one of input by way of the electronic control and produced by way of corresponding signals of a process guidance system, and wherein the adjusting of the pressure differential provides cross-section corrections in the roll nip.

* * * * *